US008844511B2

(12) United States Patent
Kaeser et al.

(10) Patent No.: US 8,844,511 B2
(45) Date of Patent: Sep. 30, 2014

(54) METHOD FOR SLICING A MULTIPLICITY OF WAFERS FROM A CRYSTAL COMPOSED OF SEMICONDUCTOR MATERIAL

(75) Inventors: Maximilian Kaeser, Burghausen (DE); Albert Blank, Obing (DE)

(73) Assignee: Siltronic AG, Munich (DE)

( * ) Notice: Subject to any disclaimer, the term of this patent is extended or adjusted under 35 U.S.C. 154(b) by 373 days.

(21) Appl. No.: 13/009,957

(22) Filed: Jan. 20, 2011

(65) Prior Publication Data

US 2011/0192388 A1 Aug. 11, 2011

(30) Foreign Application Priority Data

Feb. 10, 2010 (DE) ..... 10 2010 007 459

(51) Int. Cl.
*B28D 1/06* (2006.01)
*B28D 5/04* (2006.01)

(52) U.S. Cl.
CPC ..... *B28D 5/045* (2013.01)
USPC ..... 125/12; 125/16.01; 125/16.02; 125/21

(58) Field of Classification Search
CPC .. B28D 5/0005; B28D 5/0017; B28D 5/0023; B28D 5/0052; B28D 5/042; B28D 5/045; B28D 1/08; B24B 27/0633; H01L 21/02002
USPC ..... 125/16.01, 16.02, 20, 21, 12; 438/60
See application file for complete search history.

(56) References Cited

U.S. PATENT DOCUMENTS 5,133,332 A * 7/1992 Tanaka et al. ..... 125/39
5,187,729 A 2/1993 Ibe et al.
5,771,876 A 6/1998 Egglhuber
5,875,769 A * 3/1999 Toyama et al. ..... 125/16.01
6,763,823 B1 * 7/2004 Ikehara ..... 125/16.02
6,773,333 B2 8/2004 Lundt et al.
7,766,724 B2 8/2010 Huber et al.
7,827,980 B2 11/2010 Skovgaard-Soerensen et al.
2002/0174861 A1 11/2002 Lundt et al.
2004/0168682 A1 * 9/2004 Hammer et al. ..... 125/16.01
2006/0249135 A1 * 11/2006 Matsumoto ..... 125/21
2007/0049173 A1 * 3/2007 Hammer et al. ..... 451/8

(Continued)

FOREIGN PATENT DOCUMENTS

DE 10122628 11/2002
DE 102006044366 A1 4/2008

(Continued)

OTHER PUBLICATIONS

S. Bhagavat, I. Kao: Theoretical analysis on the effects of crystal anisotropy on wiresawing process and application to wafer slicing; in: International Journal of Machine Tool Design and Research, (46) 2006, S. 531-541, ISSN 00207357.

*Primary Examiner* — Timothy V Eley
(74) *Attorney, Agent, or Firm* — Leydig, Voit & Mayer, Ltd.

(57) ABSTRACT

A method for slicing a plurality of wafers from a crystal includes providing a crystal of semiconductor material having a longitudinal axis, a cross section and at least one pulling edge. The crystal is fixed on a table and guided through a wire gang defined by sawing wire so as to form the wafers. The guiding is provided by a relative movement between the table and the wire gang such that entry sawing or exit sawing using the sawing wire occurs in a vicinity of the at least one pulling edge of the crystal.

6 Claims, 2 Drawing Sheets

(56) References Cited

U.S. PATENT DOCUMENTS

| | | | | |
|---|---|---|---|---|
| 2008/0099006 | A1 | 5/2008 | Huber et al. | |
| 2008/0141994 | A1 | 6/2008 | Skovgaard-Soerensen et al. | |
| 2008/0264228 | A1 | 10/2008 | Huber et al. | |
| 2009/0084373 | A1* | 4/2009 | Oishi | 125/20 |
| 2010/0089209 | A1* | 4/2010 | Rieger et al. | 83/14 |
| 2011/0163326 | A1* | 7/2011 | Matsumoto | 257/76 |

FOREIGN PATENT DOCUMENTS

| | | | |
|---|---|---|---|
| DE | 102006050330 | A1 | 5/2008 |
| DE | 102006058819 | A1 | 6/2008 |
| DE | 102006058823 | A1 | 6/2008 |
| DE | 102007019566 | | 10/2008 |
| JP | 2005231248 | A | 9/2005 |
| KR | 10 2005 002 271 | A | 3/2005 |

* cited by examiner

METHOD FOR SLICING A MULTIPLICITY OF WAFERS FROM A CRYSTAL COMPOSED OF SEMICONDUCTOR MATERIAL

CROSS REFERENCE TO RELATED APPLICATIONS

This application claims priority to German Patent Application No. DE 10 2010 007 459.4, filed on Feb. 10, 2010, which is hereby incorporated by reference herein in its entirety.

FIELD

The invention relates to a method for slicing a multiplicity of wafers from a crystal.

BACKGROUND

Semiconductor wafers are generally produced by a procedure in which a mono- or polycrystalline crystal composed of semiconductor material and having a longitudinal axis and a cross section is sliced into a multiplicity of semiconductor wafers simultaneously in one work operation with the aid of a wire saw.

The workpiece can be a cylindrical single crystal composed of silicon, for example.

The term "cylindrical" should not be understood to mean that the crystals must necessarily have a circular cross section. Rather, the crystals can have the shape of any general cylinder. A general cylinder is a body which is bounded by a cylindrical surface with a closed directrix and two parallel planes, the base surfaces of the cylinder.

Such methods are therefore also suitable for sawing non-cylindrical crystal blocks which comprise a peripheral surface, that is to say e.g. crystal blocks which have a square or rectangular cross section.

Wire saws are used, in particular, for slicing a multiplicity of semiconductor wafers, solar wafers and other crystal wafers from a crystal in one work operation.

U.S. Pat. No. 5,771,876 describes the functional principle of a wire saw suitable for slicing semiconductor wafers from a crystal.

DE 10 2006 058 823 A1, DE 10 2006 058 819 A1 and DE 10 2006 044 366 A1 describe corresponding methods for wire sawing.

Wire saws have a wire gang formed by a sawing wire wound around two or more wire guide rolls.

The sawing wire can be coated with an abrasive coating. When using wire saws having a sawing wire without fixedly bonded abrasive grain, abrasive grain is supplied in the form of a slurry during the slicing process.

In the course of the slicing process, the workpiece penetrates through the wire gang, in which the sawing wire is arranged in the form of wire sections lying parallel alongside one another. The penetration of the wire gang is brought about by means of an advancing device that guides the workpiece toward the wire gang or the wire gang toward the workpiece.

When slicing semiconductor wafers from a crystal, it is customary for the crystal to be connected to a sawing strip, into which the sawing wire cuts at the end of the method. The sawing strip is a graphite strip, for example, which is adhesively bonded or cemented on the peripheral surface of the crystal. The workpiece with the sawing strip is then cemented on a support body. After slicing, the resulting semiconductor wafers remain fixed like the teeth of a comb on the sawing strip and can thus be removed from the wire saw. The residual sawing strip is subsequently detached from semiconductor wafers.

In the case of conventional methods, sliced semiconductor wafers often have increased warp values.

It has been assumed heretofore that the parameters bow and warp as a measure of the deviation of the actual wafer shape from the ideal wafer shape sought (also "sori") depend very crucially on the straightness of the cut. The parameter "warp" is defined in SEMI-standard M1-1105. The measurement variable warp is a measure of the deviation from an ideal wafer shape characterized by flat and plane-parallel wafer sides.

The warp also arises as a result of a relative movement of the sawing wire sections with respect to the workpiece which takes place in the course of the sawing process in an axial direction relative to the workpiece. This relative movement may be caused for example by cutting forces occurring during sawing, axial displacements of the wire guide rolls as a result of thermal expansion, by instances of bearing play or by the thermal expansion of the workpiece.

DE 10122628 describes a method for slicing a rod- or block-type workpiece by means of a saw, wherein the temperature of the workpiece is measured during slicing and the measurement signal is forwarded to a control unit, which generates a control signal used for controlling the workpiece temperature.

Furthermore, endeavors have been made to improve the guidance of the sawing wire.

DE 10 2007 019 566 A1 describes, for example, a wire guide roll for use in wire saws for simultaneously slicing a multiplicity of wafers from a cylindrical workpiece, which roll is provided with a coating having a thickness of at least 2 mm and at most 7.5 mm and composed of a material having a hardness according to Shore A of at least 60 and at most 99, which roll furthermore comprises a multiplicity of grooves through which the sawing wire is guided, wherein the grooves each have a curved groove base having a radius R of curvature equal to 0.25-1.6 times a sawing wire diameter D, and an aperture angle a of 60-130°.

The use of such a wire saw leads to an improvement in the waviness.

Besides the thickness variation, the flatness of the two surfaces of the semiconductor wafer is of great importance. After a wire saw has been used to slice a semiconductor single crystal, for example a silicon single crystal, the wafers thereby produced have a wavy surface. This waviness can be partly or completely removed in the subsequent steps, e.g. grinding or lapping, depending on the wavelength and amplitude of the waviness and also on the depth of the material removal. In the worst case, such surface irregularities ("undulations", "waviness"), which may have periodicities of from a few mm up to e.g. 50 mm, may still be detected even after polishing on the finished semiconductor wafer, where they have an adverse effect on the local geometry.

DE 10 2006 050 330 A1 describes a method for simultaneously slicing at least two cylindrical workpieces into a multiplicity of wafers by means of a wire gang saw having a specific gang length, wherein the at least two workpieces are fixed successively in the longitudinal direction on a mounting plate, wherein a defined distance is respectively maintained between the workpieces, the latter are clamped in the wire gang saw and sliced by means of the wire gang saw.

If a low warp value of the wafers is desired, workpieces that are as long as possible are chosen. In order to achieve high warp values, comparatively short workpieces are fixed on the mounting plate and correspondingly sawn.

It has been found, however, that, despite all measures, wafers having increased warp values repeatedly occur in the prior art. This evidently cannot always be attributed to the sawing process per se or to the thermal properties of workpiece, wire guide roll, etc.

SUMMARY

In view of the above, an aspect of the present invention is directed to providing a novel method for wire sawing.

In an embodiment, the present invention provides a method for slicing a plurality of wafers from a crystal includes providing a crystal of semiconductor material having a longitudinal axis, a cross section and at least one pulling edge. The crystal is fixed on a table and guided through a wire gang defined by sawing wire so as to form the wafers. The guiding is provided by a relative movement between the table and the wire gang such that entry sawing or exit sawing using the sawing wire occurs in a vicinity of the at least one pulling edge of the crystal.

BRIEF DESCRIPTION OF THE DRAWINGS

Exemplary embodiments of the present invention are described in more detail below with reference to the drawings, in which.

DETAILED DESCRIPTION

The crystal piece, in a manner dependent on its crystal orientation and in a manner dependent on the position of the pulling edges, is fixed on a table or a mounting plate and subsequently divided into semiconductor wafers in the wire saw in such a way that either the entry sawing process takes place in direct proximity to one of the pulling edges or the exit sawing process takes place in direct proximity to one of the pulling edges.

The inventors have ascertained that the warp values of the semiconductor wafers are very considerably dependent on the crystal plane of the workpiece at which the entry cutting process by means of the wire saw begins.

As already described above, the workpiece is guided through the wire gang, that is to say entry cutting is effected at a very specific position of the workpiece and exit cutting is effected at the opposite position on the lateral surface of the workpiece.

It has surprisingly been found that low warp values result if exit sawing is effected at the pulling edge.

In order to achieve this, the workpiece is fixed at its lateral surface in the region of the pulling edge on a sawing strip, support body or table of the wire saw.

High warp values result, by contrast, if the crystal is fixed on the support body in such a way that entry sawing is effected at one of the pulling edges.

The number of pulling edges is predetermined, in principle, by the symmetry of the crystal structure. Thus, e.g. <111>-silicon crystals have three pulling edges, cf. FIG. 1.

The workpiece to be sawn is preferably a single crystal composed of silicon.

The silicon single crystal preferably has the crystal orientation <100>, <110> or <111>.

Entry sawing is preferably effected at the pulling edge in order to produce an increased warp. This may be advantageous for subsequent process steps, for example if an epitaxial coating of the semiconductor wafer is provided.

The invention is explained below with reference to two figures.

A crystal piece was cut into two parts by means of a band saw.

The two crystal pieces 11 and 12 were cemented differently on a respective mounting plate or sawing strip 3.

The two crystal pieces 11 and 12 have the crystal orientation <111>.

A <111> crystal comprises three pulling edges 2.

Figure 1:
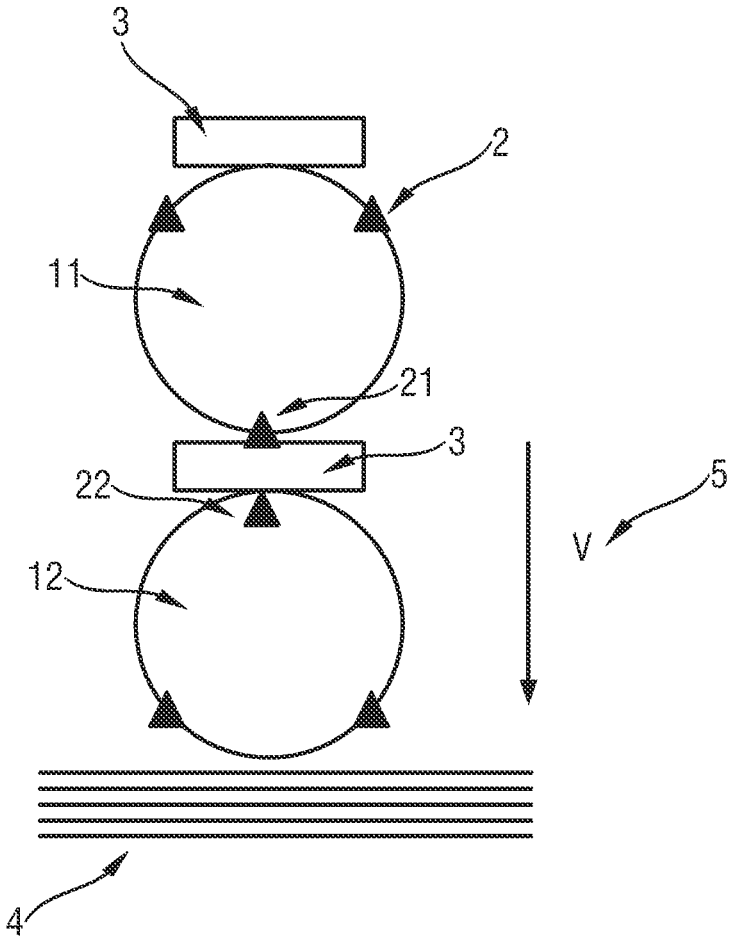
FIG. 1 schematically shows the construction of a wire saw with two workpieces.

The wire gang of the wire saw is shown in FIG. 1.

Crystal piece 12 was fixed by its lateral surface in the vicinity of a pulling edge 22 on the sawing strip 3 (exit cutting at pulling edge).

Crystal piece 11 was fixed by that side of the lateral surface which lies opposite a pulling edge 21 on the sawing strip 3 (entry cutting at pulling edge).

Both crystal pieces 11 and 12 were sawn in one work operation in order to ensure identical process conditions. The direction 5 of the relative movement v between workpieces 11 and 12 and wire gang 4 is shown in FIG. 1.

Figure 2:
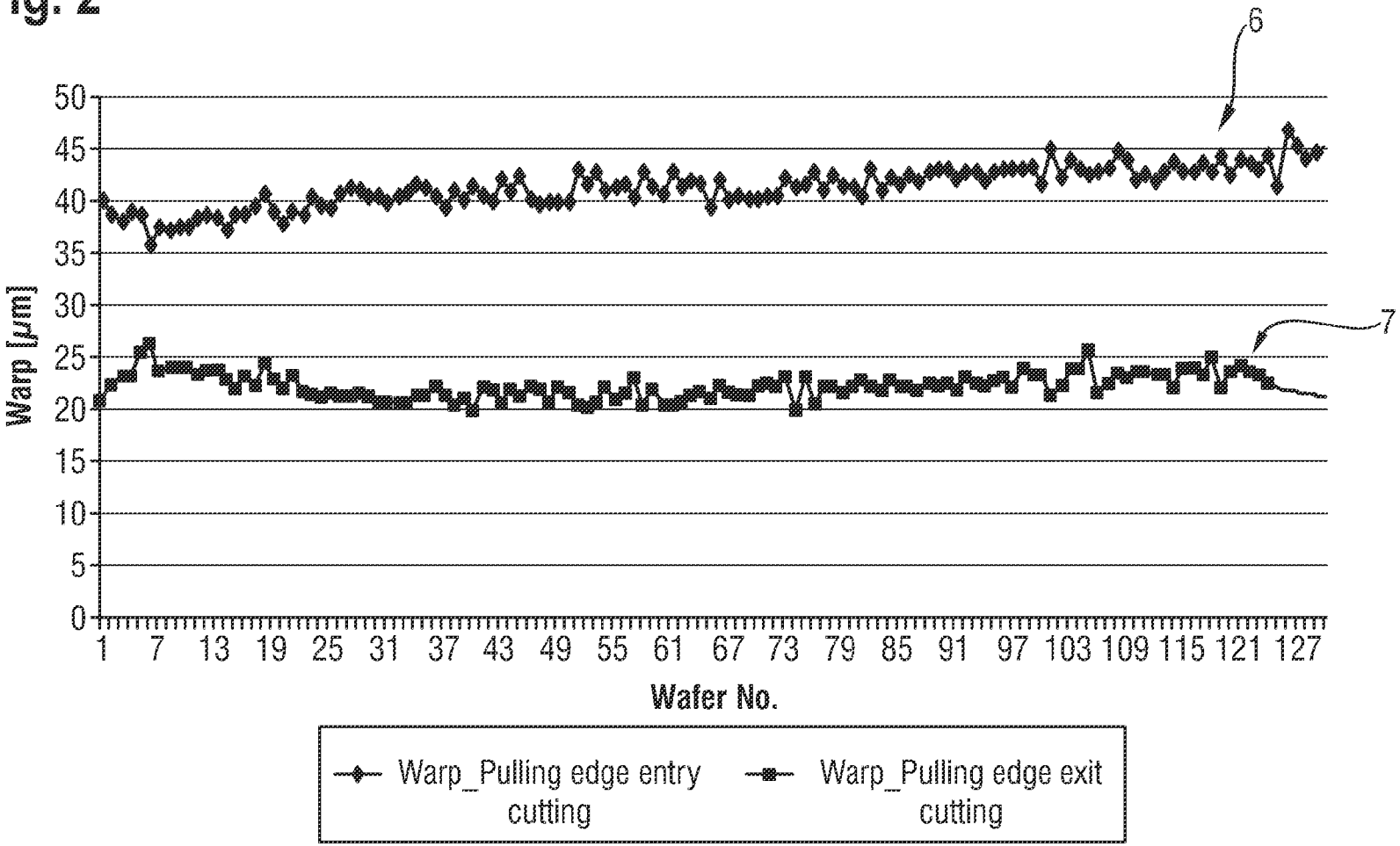
FIG. 2 shows the results of warp measurements on sawn <111> crystals composed of silicon.

All the sliced wafers were examined with regard to warp, thus resulting in the distribution shown in FIG. 2.

A warp distribution 7 that is better by an order of magnitude is manifested for the case of exit cutting at the pulling edge.

The warp distribution 6 for the crystal piece at which the entry cutting was effected at the pulling edge is shown in FIG. 2.

LISTING OF THE REFERENCE NUMERALS

11, 12 Crystal pieces
2 Pulling edge
21 Pulling edge at which entry sawing is effected
22 Pulling edge at which exit sawing is effected
3 Sawing strip
4 Wire gang of the wire saw
5 Relative movement between workpieces and a wire gang
6 Warp distribution "entry sawing at pulling edge"
7 Warp distribution "exit sawing at pulling edge"

What is claimed is:

1. A method for slicing a plurality of wafers from a crystal comprising:

providing a crystal of semiconductor material having a longitudinal axis, a cross section and at least one pulling edge;

fixing the crystal on a table;

guiding the crystal through a wire gang defined by sawing wire so as to form the wafers, the guiding provided by a relative movement between the table and the wire gang such that the wire gang initiates or completes cutting of crystal in a vicinity of a selected pulling edge of the crystal.

2. The method recited in claim 1, wherein the crystal includes silicon and has an orientation of <100>, <110> or <111>.

3. The method recited in claim 2, wherein the guiding is conducted such that the sawing wire exits the crystal at the selected pulling edge of the crystal so as to form wafers having a reduced warp.

4. The method recited in claim 2, wherein the guiding is conducted such that the sawing wire enters the crystal at the selected pulling edge of the crystal so as to form wafers having increased warp.

5. The method recited in claim 1, wherein the guiding is conducted such that the sawing wire exits the crystal at the selected pulling edge of the crystal so as to form wafers having a reduced warp.

6. The method recited in claim 1, wherein the guiding is conducted such that the sawing wire enters the crystal at the selected pulling edge of the crystal so as to form wafers having increased warp.

* * * * *